US008730768B2

(12) United States Patent
Goeller

(10) Patent No.: US 8,730,768 B2
(45) Date of Patent: May 20, 2014

(54) MECHANISM FOR SELECTIVELY STOPPING THE STRIKING MECHANISMS OF A TIMEPIECE ACCORDING TO THE AVAILABLE DRIVE TORQUE

(75) Inventor: Eric Goeller, Les Hopitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 100 days.

(21) Appl. No.: 13/424,603

(22) Filed: Mar. 20, 2012

(65) Prior Publication Data

US 2012/0243385 A1 Sep. 27, 2012

(30) Foreign Application Priority Data

Mar. 22, 2011 (EP) ..... 11159238

(51) Int. Cl.
*G04B 9/00* (2006.01)

(52) U.S. Cl.
USPC ..... 368/66; 368/272

(58) Field of Classification Search
USPC ..... 368/66, 272–273, 71
See application file for complete search history.

(56) References Cited

U.S. PATENT DOCUMENTS 7,613,077 B2 * 11/2009 Goeller ..... 368/72
7,965,585 B2 * 6/2011 Schiesser ..... 368/269
8,000,174 B2 * 8/2011 Rochat et al. ..... 368/267
2008/0192585 A1 8/2008 Corthesy et al.
2011/0310712 A1 12/2011 Papi et al.

FOREIGN PATENT DOCUMENTS

EP 1 708 050 A1 10/2006
EP 1 760 545 A1 3/2007
EP 1 925 997 A1 5/2008
EP 2 226 688 B1 9/2010
WO WO 2006/103289 A2 10/2006

OTHER PUBLICATIONS

Translation ep1760545—epo.org; Sep. 20, 2013.*
European Search Report issued Nov. 10, 2011, in European Application No. EP 11159238, filed Mar. 22, 2011, (with English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

A timepiece including a movement, a mechanism controlling the power reserve of a drive means with an arbor whose angular position indicates said available torque, a striking mechanism controlled by a striking mechanism control mechanism, and a locking lever arranged to lock said movement. The timepiece includes a selective stop mechanism according to the drive torque available in the drive means, which manages said available drive torque by limiting or not limiting the operation of all of part of the striking works of said striking mechanism, by a transmission mechanism controlling an isolating wheel set controlling the position of said locking lever and arranged to release or prevent the movement of a striking mechanism control rod linkage and/or to allow or prevent the strike of a hammer on a gong.

9 Claims, 8 Drawing Sheets

MECHANISM FOR SELECTIVELY STOPPING THE STRIKING MECHANISMS OF A TIMEPIECE ACCORDING TO THE AVAILABLE DRIVE TORQUE

This application claims priority from European Patent Application No. 11159238.2 filed Mar. 22, 2011, the entire disclosure of which is incorporated herein by reference.

FIELD OF THE INVENTION

The invention concerns a timepiece including a drive means, a movement, a mechanism for controlling the power reserve of said drive means which includes an output arbour whose angular position indicates the available power reserve in said drive means, a striking mechanism which includes at least one hammer and at least one gong and is controlled by a striking mechanism control mechanism, which includes a lever for locking said movement.

The invention concerns the field of horology and in particular portable timepieces such as watches or similar, which have a limited power reserve.

In particular, the invention concerns timepieces with complications, and especially with striking mechanisms, because of the significant power consumption of such complications.

BACKGROUND OF THE INVENTION

Stopping the functions of a complicated timepiece is always problematic, whether this concerns inadvertently stopping the movement, or stopping certain complications, in particular when they are in operation, since restarting often requires adjustment of certain functions, when the drive means are recharged to restart the timepiece.

It is therefore preferable, when there is insufficient energy available to perform certain functions, to stop all or part of these functions, and/or the movement. In particular, the striking functions are energy intensive users, and stopping the striking mechanisms prevents the inadvertent stopping either of a particular striking mechanism which is in operation, or of the performance by the movement of a particular complication comprised in the timepiece.

It is a question of ensuring that each complication is returned to a rest mode prior to being completely stopped. This is the required condition to ensure that the timepiece can subsequently restart properly with respect to all of the functions.

Known mechanisms for checking power reserve do not allow action by estimating power levels according to the power consumption of the complications, and they do not allow the different functions to be stopped in succession, according to their power consumption.

EP Patent Application No 1 760 545 A1 in the name of MONTRES JOURNE SA discloses a timepiece with a barrel common to the movement and the striking mechanism, with a mechanism preventing inadvertent stopping by blocking both the passing and the on demand striking mechanism. This mechanism includes a pivoting cam in desmodromic connection with the barrel arbour and drum, with a pivoting amplitude limited to 360°, forming the power reserve indicator. A coupling lever is located between the racks of the striking mechanism and the strike train, and is controlled by a release lever and a locking mechanism having two positions:

- one where the coupling lever can be moved into an uncoupling position when it is released by the release lever;
- and the other where it is retained in a coupling position by the locking mechanism.

The locking mechanism includes a means for meshing alternatively with the pivoting cam to move it between the two positions thereof.

SUMMARY OF THE INVENTION

The invention proposes to implement a safety mechanism which only allows certain complications to be started, particularly striking mechanisms, if their cycle can be performed completely.

The invention therefore concerns a timepiece including a drive means, a movement, a mechanism for checking the power reserve of said drive means which includes an output arbour whose angular position indicates the power reserve available in said drive means, a striking mechanism which includes at least one hammer and at least one gong and is controlled by a striking mechanism control mechanism, which includes a lever for locking said movement, characterized in that the timepiece includes, inserted between said output arbour and said locking lever, a selective stopping mechanism, for selectively stopping strikes of said timepiece, according to the drive torque available in said drive means, and characterized in that said selective stopping mechanism is arranged to manage the available torque in said drive means by limiting or not limiting the working of the strikes, according to said angular position of said output arbour, to control a mechanism for uncoupling all or part of the available striking works in the striking mechanism, via a transmission mechanism controlling an isolating wheel set, which is comprised in said selective stopping mechanism and arranged to control the position of said locking lever and further arranged to release or prevent the movement of a striking mechanism control rod linkage and/or to allow or prevent the strike of a hammer against a gong.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figures 1A, 1B:
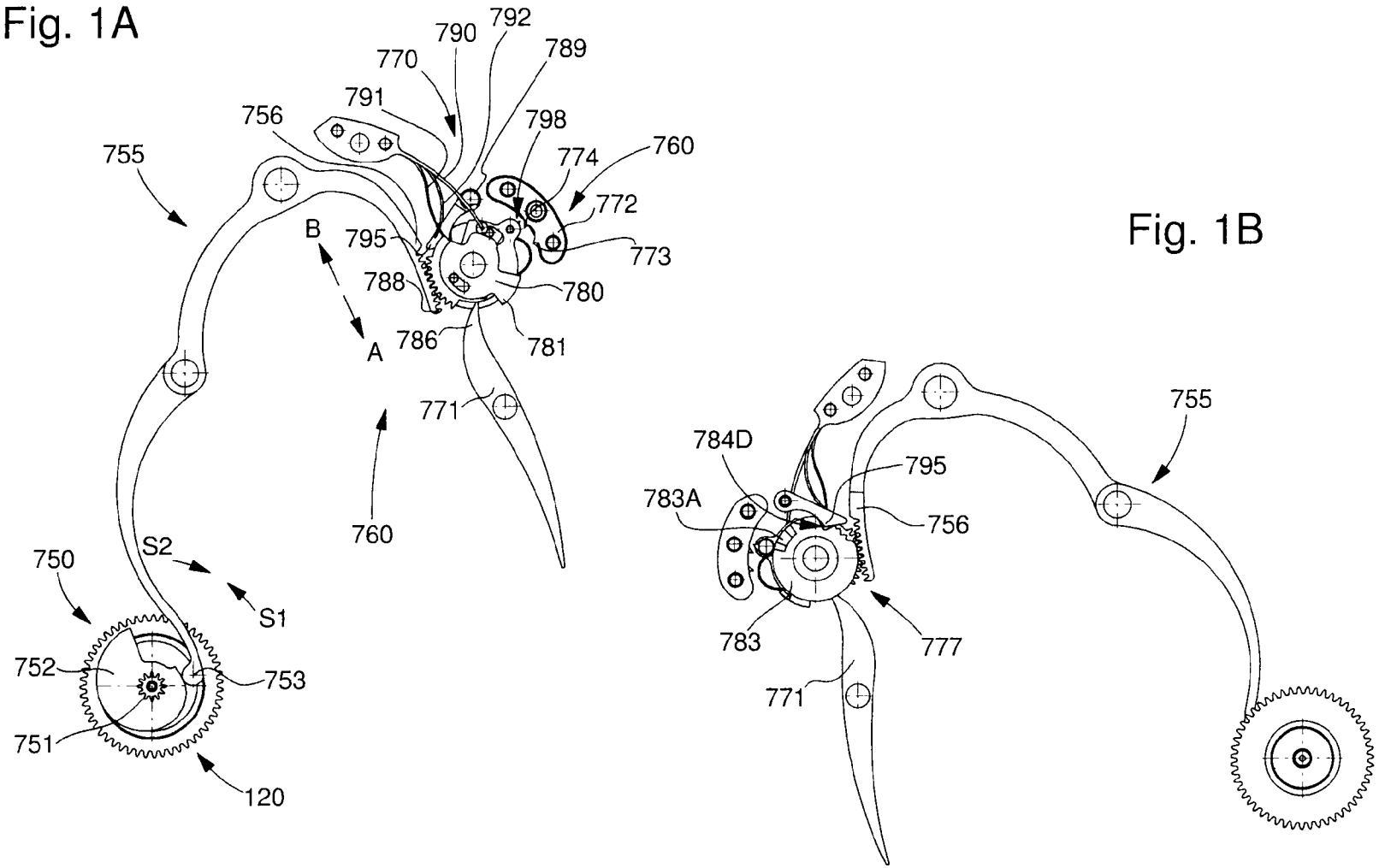
FIG. 1 shows a schematic, partial, plan view, seen from the top in FIG. 1A and the bottom in FIG. 1B, of a mechanism for selectively stopping a striking mechanism according to the invention, including an isolating wheel set, for a timepiece including a drive means and a power reserve control mechanism, with the drive means in a state of maximum winding, corresponding to the full operation of the striking mechanisms and the movement.

The invention concerns the field of horology and in particular portable timepieces such as watches or similar, which have a limited power reserve.

In particular, the invention concerns timepieces with complications, and especially with striking mechanisms, because of the significant power consumption of such complications.

The invention is described here in a non-limiting manner for a timepiece with complications, some of which are striking mechanisms. Naturally, the invention can be used in a similar manner for managing different functions or complications which use energy, so as to establish priorities of survival between said functions, when there is a decrease in potential available energy, while ensuring that each function is returned to a rest state, to guarantee that restarting occurs normally when the timepiece concerned is supplied with power again.

The invention concerns a timepiece 1000 including a drive means 120, a movement 200 and a power reserve control mechanism 750 for said drive means 120. This power reserve control mechanism 750 includes an output arbour 751 whose angular position indicates the available power reserve in drive means 120. This drive means 120 is formed by a barrel or a set of barrels, or similar.

Timepiece 1000 includes a striking mechanism control mechanism 1, which is arranged to control a striking mechanism 100 and which includes a device for starting the stopping of movement 200 by action on a control lever or similar. The invention is described here for a version where the striking mechanism control mechanism 1 includes a lever 771 for locking movement 200. More specifically, the entry point thereof is a locking lever 771 of the stop-seconds type in the example shown in the Figures. Striking mechanism 100 includes at least one hammer and at least one gong.

According to the invention, this timepiece 1000 includes, inserted between the output arbour 751 and the locking lever 771, a selective stop mechanism 760 for selectively stopping the strikes of striking mechanism 100 of timepiece 1000, according to the drive torque available in drive means 120. This selective stop mechanism 760 is arranged to manage the torque available in drive means 120 by limiting or not limiting the operation of the strikes, according to the angular position of the output arbour 751, to control a mechanism for uncoupling all or part of the available striking works in striking mechanism 100, via a transmission mechanism 755 which actuates an isolating wheel set 770 comprised in selective stop mechanism 760 and which is arranged to control the position of locking lever 771 and which is further arranged to release or prevent the movement of a striking mechanism control rod linkage 700 and/or to allow or prevent the strike of a hammer on a gong.

The mechanism 760 is arranged, directly or indirectly, in at least one of the operating positions, to prevent a strike from playing, by locking a lifting piece which controls the playing of a strike, which, in a non-limiting variant, is a lifting piece actuating a hammer to strike a gong, bell or similar, or a similar audible striking mechanism or musical box, or by directly locking this type of hammer or similar.

In the event that striking mechanism 100 has several striking modes, mechanism 760 is advantageously arranged to cause the stopping of certain striking mechanisms in relation to each other in a manner differed in time.

Mechanism 760 is further arranged, directly or indirectly, in at least one operating position thereof, to prevent the operation of the movement by an action causing the pivoting of the locking lever 771 or the stop control device of the movement concerned.

The invention is described more specifically here, in a non-limiting manner, for the actuation of this type of locking lever 771.

The invention enables the timepiece to manage the torque available in said drive means 120, via this mechanism 760, by limiting or not limiting the operation of the striking mechanisms, whether they are wound or not, or by stopping the movement 200 when the power reserve is insufficient to ensure proper operation. This operating mode is useful for a complicated timepiece, since controlled stopping of the movement or the striking mechanisms can prevent the inadvertent stopping either of a particular striking mechanism which is in operation, or of the performance by the movement of a particular complication comprised in the timepiece. The invention thus enables each complication to be returned to a rest mode prior to being completely stopped. Subsequent restarting of the timepiece is thus guaranteed for all of the functions, and no adjustment or shifting is necessary apart from setting the time when drive means 120 is recharged to restart the timepiece.

The invention is thus suited to the control of a timepiece 1000 or a movement 200 which includes a power reserve checking mechanism 750, which comprises an output arbour 751.

The invention uses an item of data relative to the available power reserve in said drive means 120, comprising the angular position of said output arbour 751, to control a mechanism for uncoupling all or part of the available striking works in striking mechanism 100, or for stopping movement 200.

The item of data is reversible, since said output arbour 751 pivots in a first direction S1 when drive means 120 is being discharged and in the opposite direction S2 when it is being recharged. Thus, when drive means 120 is recharged by winding or similar, mechanism 760 according to the invention is devised to release in sequence the functions which it has locked, as soon as sufficient energy is available for the proper operation of said functions.

This output arbour 751 carries a cam 752 which cooperates with a feeler spindle 753 comprised in a transmission mechanism 755 for controlling, directly or indirectly, the movement of a rack 756.

Figure 4B:
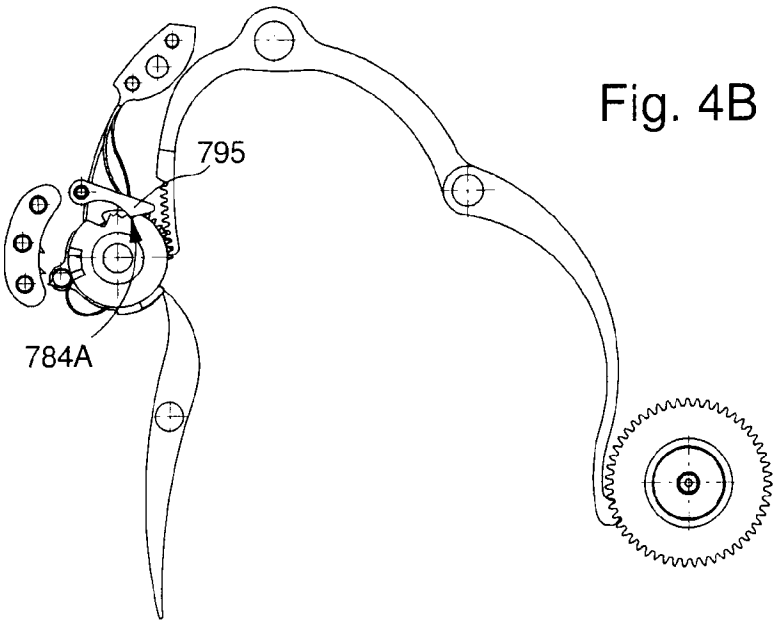
FIG. 4 shows a schematic, partial, plan view, seen from the top in FIG. 4A and from the bottom in FIG. 4B, of the mechanism of FIG. 2, in a state of complete let down, where all of the striking mechanisms are locked, and where the movement is locked.
Figure 4A:
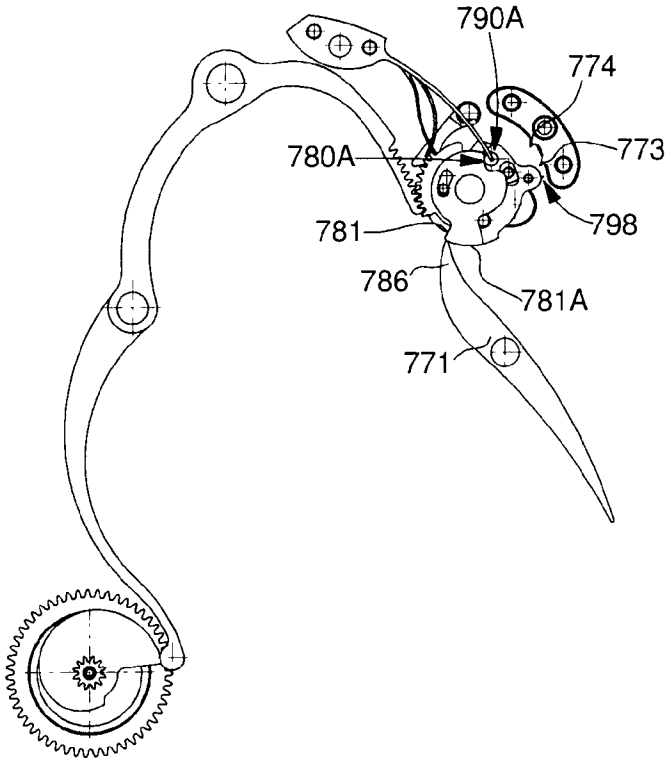

Cam 752 is preferably, as shown in the Figures, a snail cam, of substantially uniform increasing radius, the smallest radius corresponding to the maximum winding position of drive means 120 in FIG. 1A and the largest radius corresponding to the let down position of drive means 120 in FIG. 4A.

This rack 756 controls the pivoting of an isolating wheel set 770, comprised in selective stop mechanism 760, and which is arranged to control the position of locking lever 771 according to the angular position of output arbour 751, preferably by acting on a beak 786 comprised in locking lever 771.

This isolating wheel set 770 includes the following elements, superposed on each other and arranged to pivot about the same pivot axis DP:

a striking mechanism stop cam 783;

a striking mechanism stop wheel 745;

a surprise-piece for stopping the movement 780.

Figure 9:
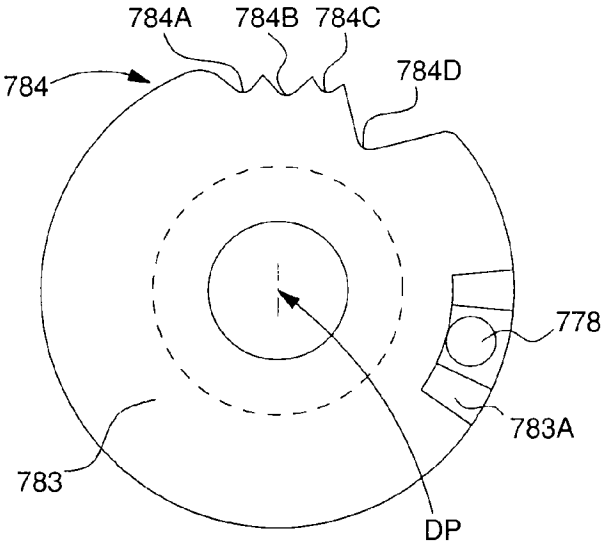
FIG. 9 shows a schematic, perspective view of a striking mechanism stop cam comprised in the wheel set of FIG. 5.
Figure 10:
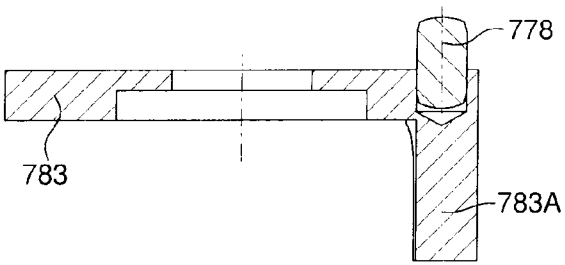
FIG. 10 shows a schematic cross-section passing through the pivot axis of the cam of FIG. 10 and a stud comprised therein.
Figure 13:
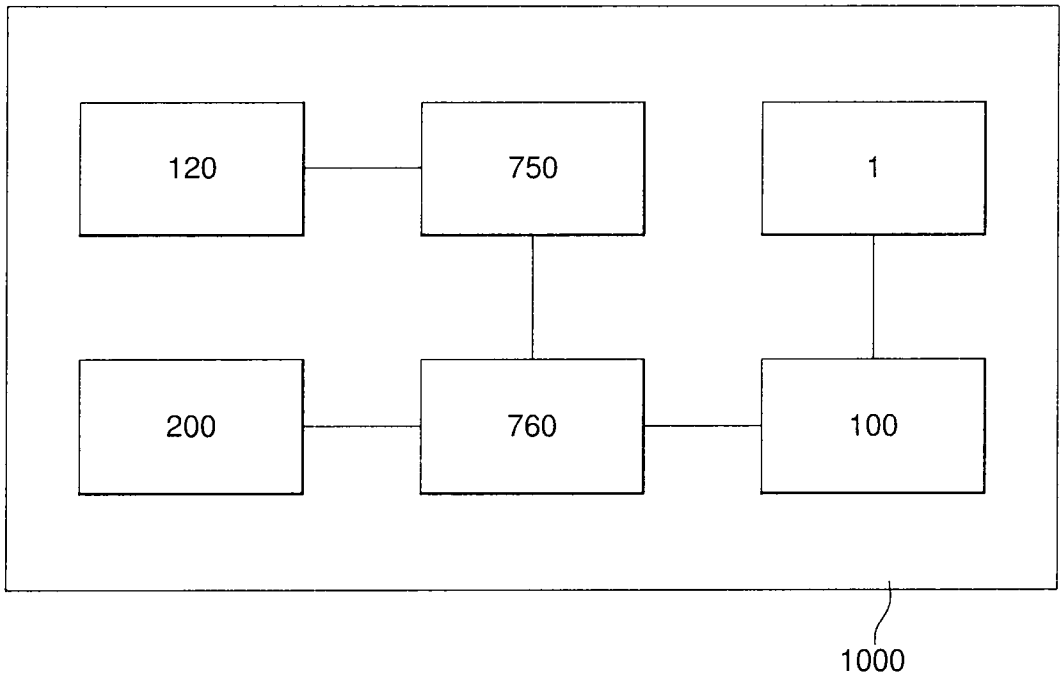
FIG. 13 shows a block diagram of a timepiece including a mechanism for selectively stopping a striking mechanism according to the invention.

The striking mechanism stop cam 783 includes a plurality of peripheral notches 784. In a particular variant illustrated in the Figures, which is for use with a striking mechanism 100 which has several strike modes, which can be switched by action on a control rod linkage, and in particular one mode where all of the striking mechanisms operate automatically or on the manual command of a user, and another mode where the striking mechanisms can only operate automatically. There are four of said notches: 784A, 784B, 784C, 784D, as seen in FIG. 9.

Each of said notches 784 is arranged to cooperate, in a particular angular position of cam 783, with a beak 795 comprised in a click 789 pushed towards pivot axis DP by a spring 791.

Notch 784A is for the minimum power reserve level, at which the stopping of movement 200 must be initiated. Notch 784D is for the maximum power reserve level, where drive means 120 is at maximum capacity and where mechanism 760 does not exert any impeding action either on striking mechanism 100 or on movement 200.

Between these two positions, the intermediate notches, here 784C and 784B, correspond to positions where it is chosen to stop, respectively, the operation of all of the automatic striking mechanisms, and the operation of all of the striking mechanisms including on manual command by the user.

This cam 783 carries a pin 778 substantially parallel to the pivot axis DP thereof, projecting from a top side of a substantially flat flange, the periphery of which includes notches 784, for cooperating with the other stages of isolating wheel set 770.

Cam 783 further includes a stud 783A projecting substantially parallel to pivot axis DP and located on a bottom side opposite to the top side of said flange.

This stud 783A is arranged to move and insert itself in the kinematic strike chain of a striking mechanism 100 and, in particular, in the preferred example embodiment illustrated in the Figures, on the trajectory of a hammer, between said hammer and a gong or similar, according to the angular position of striking mechanism stop cam 783.

When beak 795 of click 789 is positioned in notch 784C for locking the automatic strikes, stud 783A is inserted between a first release hammer peculiar to these striking mechanisms, not shown in the Figures, and the corresponding gong, or similar.

When beak 795 of click 789 is positioned in notch 784B for locking all the striking mechanisms which are manually released by the user, stud 783A is again inserted between a second release hammer peculiar to these striking mechanisms, not shown in the Figures, and the corresponding gong, or similar.

When beak 795 occupies notch 784A, mechanism 760 locks movement 200 as will be explained hereinafter.

The striking mechanism stop wheel 745 includes an external toothed sector 779, which is arranged to cooperate with a toothing 788 comprised in rack 756. This striking mechanism stop wheel 745 includes an oblong hole 777, which allows a limited movement of pin 778 of cam 783, which limits the relative pivoting of striking mechanism stop wheel 745 relative to striking mechanism stop cam 783.

In proximity to this oblong hole 777, striking mechanism stop wheel 745 carries a pivot 747 for the pivoting of a lifting piece with two beaks 797, which comprises a first beak 798 turned towards pivot axis DP, and a second beak 799, moving away therefrom in a substantially radial direction.

Figure 5:
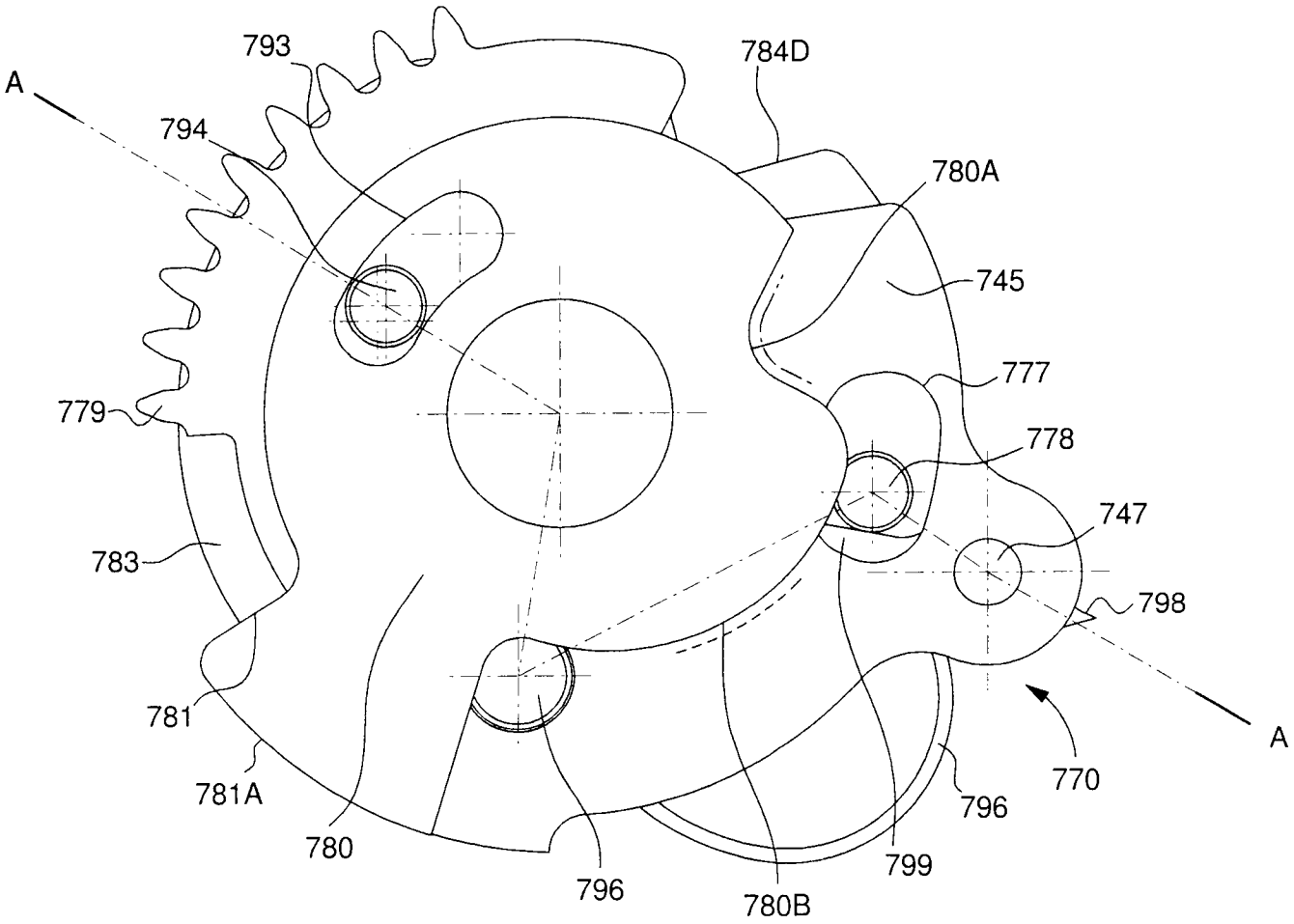
FIG. 5 shows a schematic, plan view of the isolator wheel set according to the invention.
Figure 6:
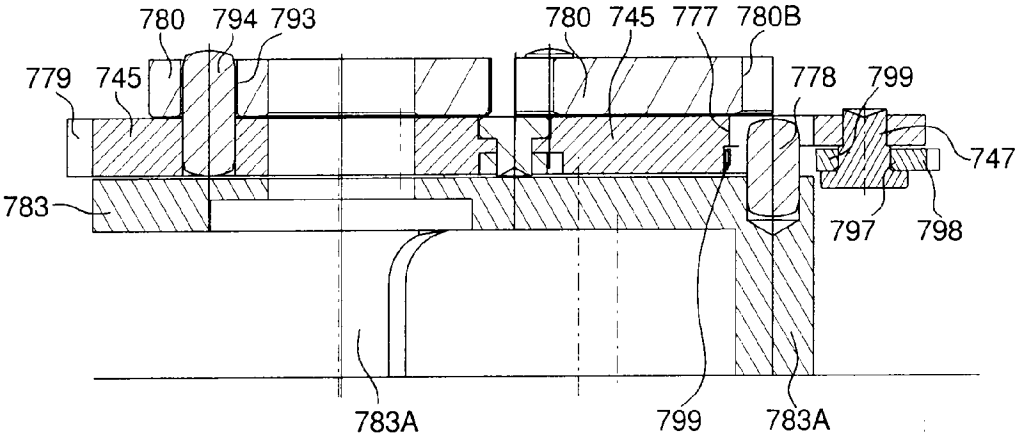
FIG. 6 shows a schematic cross-section AA of the wheel set of FIG. 5.
Figure 8:
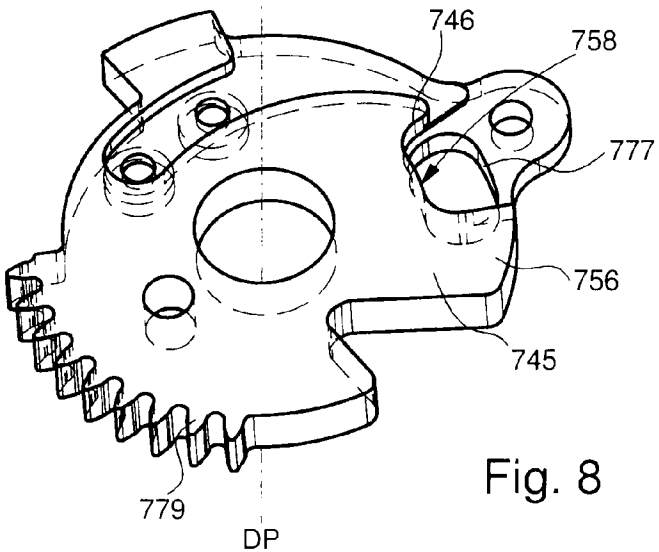
FIG. 8 shows a schematic, perspective view of a striking mechanism stop wheel comprised in the wheel set of FIG. 5.
Figure 7:
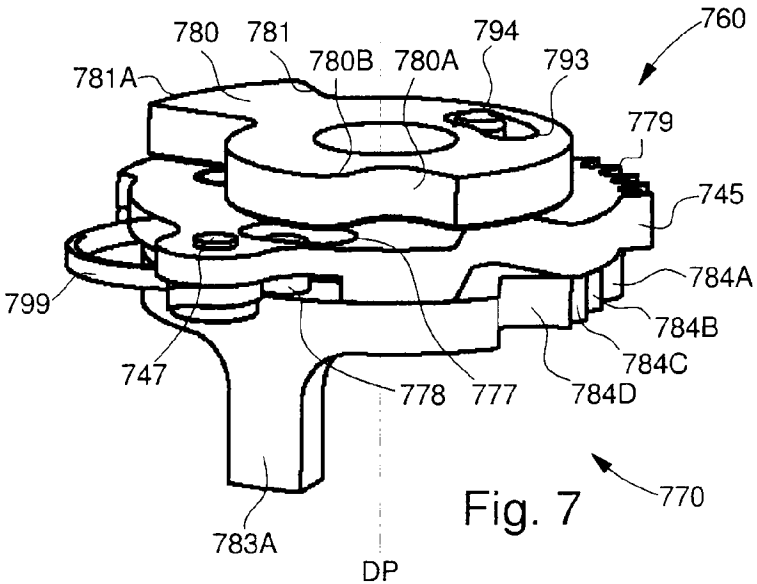
FIG. 7 shows a schematic, perspective view of the wheel set of FIG. 5.

The striking mechanism stop wheel 745 carries a spring 796 for returning lifting piece 797 into a position that tends to reduce the extreme radial position of second beak 799 and tends to pivot lifting piece 797 clockwise in FIG. 5.

Moreover, the striking mechanism stop wheel 745 comprises, on one face thereof which, in the example illustrated in the Figures, is a bottom face turned towards the top face of cam 783, a peripheral recess 758 between an arm 756 and a boss 757 including a bearing surface 746, said arm 756 and said boss 757 framing the oblong hole 777. The bearing surface 746 forms a stop surface for the second beak 799 of the lever with two beaks 797.

The striking mechanism stop wheel 745 also carries a pin 794 substantially parallel to pivot axis DP. Said pin projects from the side of a top surface of wheel 745 opposite the bottom face thereof. One end of toothed sector 779 acts as support for a return spring 792, which is fixed to the plate or a bridge of movement 200 and which tends to pivot said toothed sector 779 in the anti-clockwise direction in FIG. 5.

Depending on its position, lifting piece 797 may partially cover hole 777 and form a stop member for pin 778.

Figure 11:
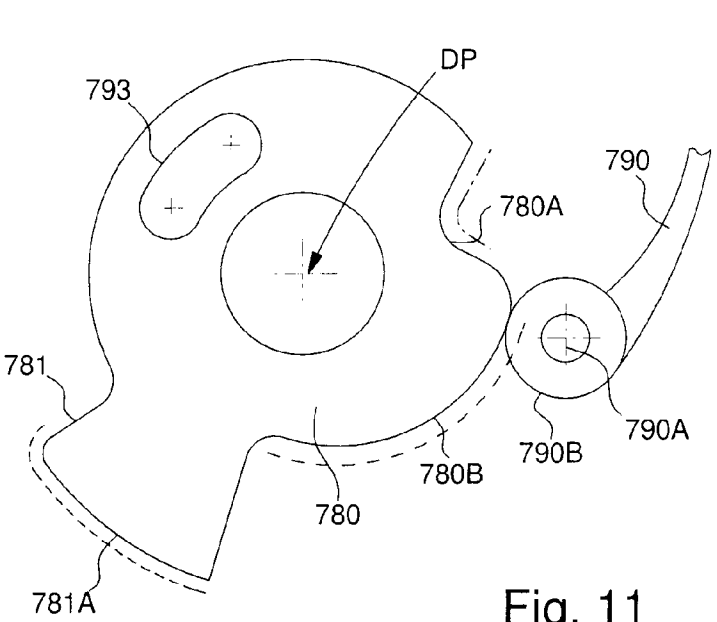
FIG. 11 shows a schematic, perspective view of a surprise-piece for stopping the movement comprised in the wheel set of FIG. 5.
Figure 12:
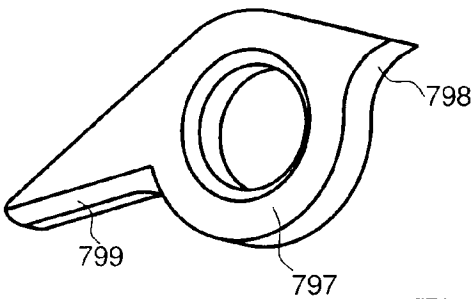
FIG. 12 shows a schematic, perspective view of a lifting piece with two beaks comprised in the wheel set of FIG. 5.

The surprise-piece 780 for stopping the movement comprises an arm provided with an operating area 781A, shown in dotted lines in FIG. 11, which ends on a bearing surface 781 and is arranged to cooperate in abutment with beak 786 of uncoupling lever 531, and, depending on the position thereof, to lock or release movement 200.

This surprise-piece 780 includes an oblong hole 793 which is arranged to allow the movement of a pin 794 of striking mechanism stop wheel 745 and limits the relative pivoting between the striking mechanism stop wheel 745 and the movement stop surprise-piece 780.

This movement stop surprise-piece 780 further includes a peripheral rolling zone 780A, shown in a broken line in FIG. 11, which ends in a bearing notch 780A, shown in dot and dash lines in FIG. 11, closer to pivot axis DP than the remainder of rolling area 780B. This peripheral rolling surface is arranged to act as a raceway for a roller 790B, pivoted on a pivot 790A of a spring 790 which is fixed to the plate or a bridge of movement 200 and tends to press said roller 790B, substantially radially relative to pivot axis DP, in rolling abutment on rolling area 780B or in a holding position in rolling notch 780A.

Selective stop mechanism 760 further comprises a toothed part 772, which is fixed to the plate or a bridge of movement 200, and includes a first tooth 773 and a second tooth 774 which are both located on the trajectory of the second beak 798 of lifting piece 797, when the latter is in maximum radial extension. The gap between this first tooth 773 and second tooth 774 is close to the gap between the end positions that pin 778 can occupy in hole 777 of striking mechanism stop wheel 745.

Preferably, the ends of maximum radial extension of these teeth 773 and 774 towards pivot axis DP are located on the same radius RE.

The complete let down position of drive means 120 corresponds to the cooperation of notch 784A of striking mechanism stop cam 783 with the beak 795 of click 789.

At this stage, stud 783A locks all the striking mechanisms, and the toothed sector 788 of rack 756 is in a position at a maximum distance from isolating wheel set 770.

When drive means 120 starts to be recharged, rack 756 is moved closer to wheel set 770, in direction A in FIG. 1A.

This movement causes toothed sector 779 of wheel 745 to pivot.

Spring 790 is arranged so as to buckle only very slightly, it tends then to push roller 790B, from rolling surface 780B in notch 780A, and thus to cause surprise-piece 780 to pivot in the clockwise direction in FIG. 5, and therefore to release beak 786 from locking lever 771. Movement 200 is thus released. The play existing between pin 794 of wheel 745 and oblong hole 793 of surprise-piece 780 allows the surprise-piece to be released in a single stroke, and an all-or-nothing operation to be performed to move beak 786 in a single stroke.

The continuing travel of rack 756 and sector 779 causes sector 779 to pivot anti-clockwise in FIG. 5.

Since surprise-piece 780 was locked in position by the action of roller 790B in notch 780A, the possible pivoting travel of wheel 745 relative to this fixed position of surprise-piece 780 is limited by the clearance of pin 794 of wheel 745 in oblong hole 793 of surprise-piece 780.

This reduced angular travel allows first beak 798 of lifting piece 797, which tends to pivot anti-clockwise in FIG. 5, to pass in succession over first tooth 773, then second tooth 774 of toothed part 772.

The passing of each of the two teeth 773 and 774 forces lifting piece 797 to pivot about its pivot axis 747 to allow first beak 798 to take a position in which the maximum radial extension thereof is less than radius RE. The second beak 799 then has to push pin 770 and thus pivot cam 783 in order to move and occupy a new position on another of notches 784, in this case 784B, when first beak 798 passes over first tooth 773, and 784C when it passes over the second tooth 774.

Spring 796 returns first beak 798 to its maximum extension after each of teeth 773 and 774 has passed.

During the complete winding of drive means 120, the maximum pivoting of wheel 745 drives pin 778 of cam 783 and causes said cam to move into the angular position where notch 784D cooperates with beak 795 of click 789.

Figure 2B:
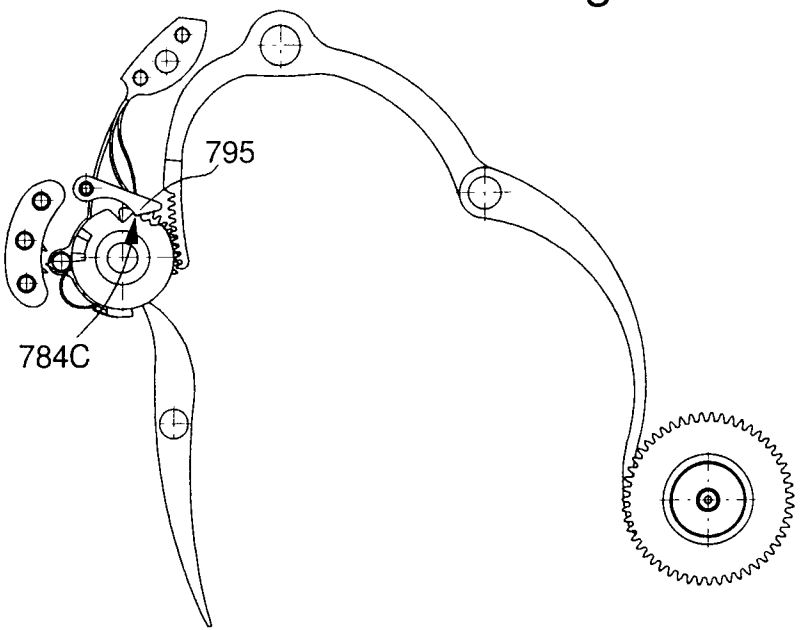
FIG. 2 shows a schematic, partial, plan view, seen from the top in FIG. 2A and from the bottom in FIG. 2B, the timepiece of FIG. 2, in a state of partial let down, where the automatic striking mechanism is locked, and where the movement is operating.
Figure 2A:
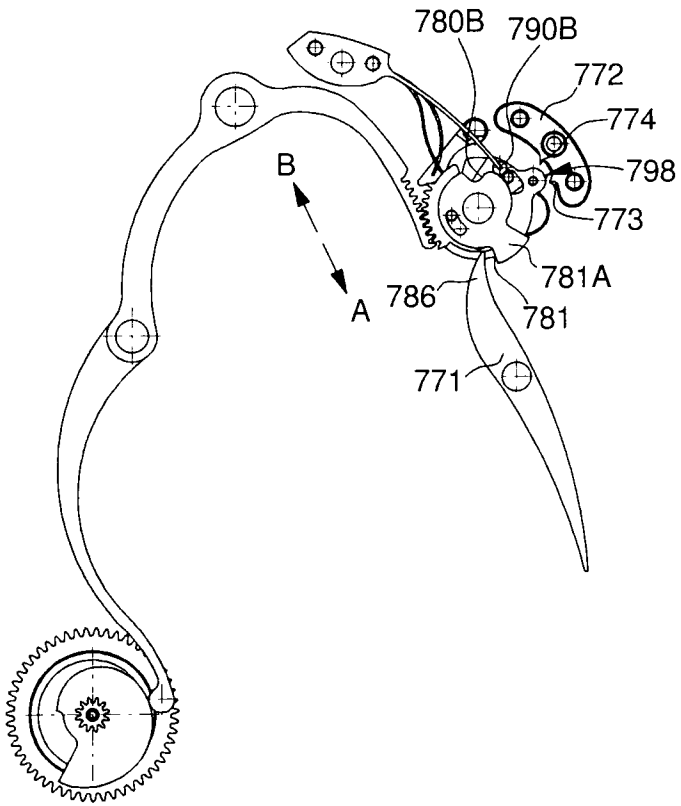

In reverse operation, the letting down of drive means 120 results in a movement of rack 756 in direction B of FIG. 1A. As seen in FIG. 2, which shows maximum winding and full operation of the striking mechanisms and of the movement, feeler spindle 753 is then on the smallest radius of cam 752, when the winding of drive means 120 is maximum.

Beak 795 of click 789 is then in notch 784D, which is the deepest.

Roller 790B of spring 790 then rolls over rolling surface 780B.

Beak 786 of locking lever 771 is at a distance from bearing surface 781 of the surprise-piece and is opposite thereto.

Wheel 745 then pivots clockwise in FIG. 5, driving pin 778 of cam 783 with the end of the hole 777 the furthest from pivot 747.

Figure 3B:
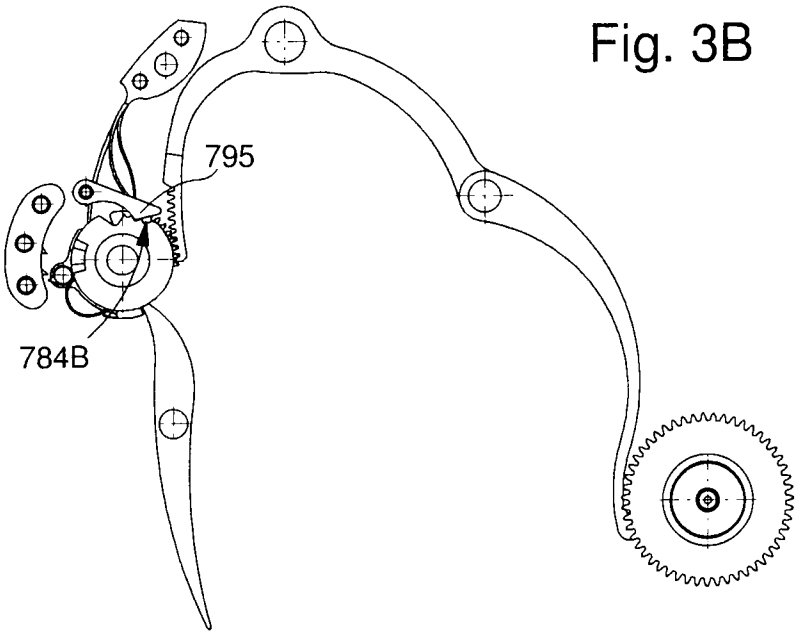
FIG. 3 shows a schematic, partial, plan view, seen from the top in FIG. 3A and from the bottom in FIG. 3B, of the mechanism of FIG. 2, in a state of partial let down, where all of the striking mechanisms are locked, and where the movement is operating.
Figure 3A:
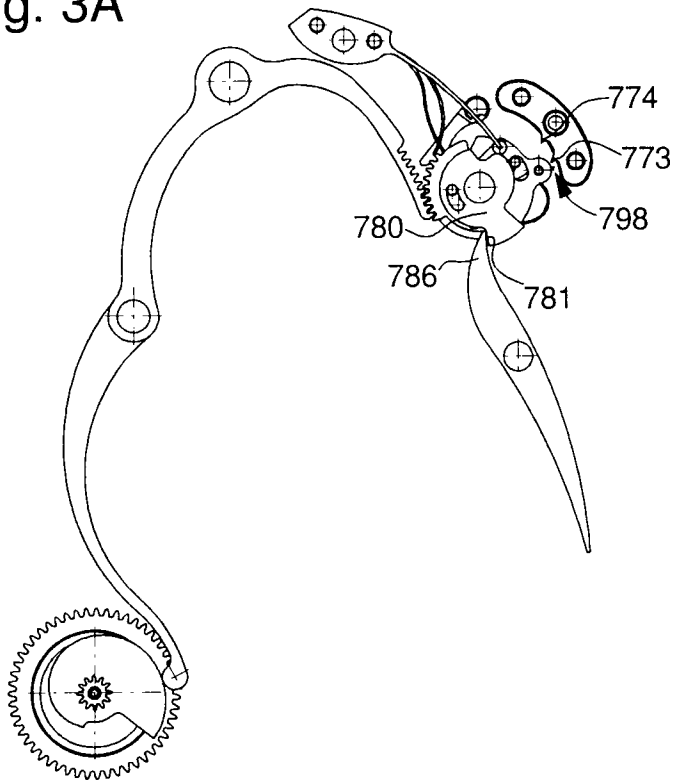

As seen in FIGS. 3 and 4, each tooth, second tooth 774, then first tooth 773, is passed over in succession by the first beak 798, each time causing lifting piece 797 to pivot against spring 796. The continued pivoting of wheel 745 causes the pivoting of cam 783 and the successive jump from one notch to another of successive notches 784D to 784C then 784B.

The position of crossing second tooth 774 corresponds to the position of beak 795 of click 789 in the notch 784C corresponding to the locking of the automatic striking mechanisms and leads to the locking, by stud 783A of cam 783, of the first release hammer peculiar to these striking mechanisms, and the corresponding gong or similar.

FIG. 3 illustrates a state where the automatic striking mechanism is locked and where the movement is operating.

First beak 798 is between second tooth 774 and first tooth 773.

Beak 795 of click 789 is in notch 784C and hammer 531 is therefore locked.

Roller 790B of spring 790 is still rolling on rolling surface 780B.

Beak 786 of locking lever 771 moves closer to bearing surface 781 of surprise-piece 780.

FIG. 4 illustrates a state where all of the striking mechanisms are locked, and where the movement is operating.

The passing of first tooth 773 corresponds to the position of beak 795 of click 789 in the notch 784B corresponding to the locking of the striking mechanisms which are manually released by the user, stud 783A is again inserted between a second release hammer peculiar to these striking mechanism and the corresponding gong or similar.

Roller 790B of spring 790 is still rolling over rolling surface 780B and approaching notch 784A.

Beak 786 of locking lever 771 comes closer and moves into contact with the bearing surface 781 of surprise-piece 780.

FIG. 4 illustrates a state where all of the striking mechanisms are locked and where the movement is locked.

After the first tooth 773 has been crossed and at the end of the letting down of drive means 120, roller 790B of spring 790 abruptly penetrates notch 780A and bearing surface 781 of surprise-piece 780 then acts on beak 786 of locking lever 771, which rises on operating area 781A to actuate the locking of movement 200.

What is claimed is:

1. A timepiece comprising:

a drive means;

a movement;

a mechanism for controlling a power reserve of said drive means which includes an output arbour whose angular position indicates said power reserve available in said drive means;

a striking mechanism which includes at least one hammer and at least one gong and is controlled by a striking mechanism control mechanism, which includes a lever for locking said movement, wherein the timepiece includes, inserted between said output arbour and said locking lever, a selective stopping mechanism, for selectively stopping one or more strikes of said timepiece, according to a drive torque available in said drive means, wherein said selective stopping mechanism is arranged to manage said drive torque available in said drive means by limiting or not limiting one or more workings of said one or more strikes, according to said angular position of said output arbour, to control a mechanism for uncoupling all or part of said one or more workings of said one or more strikes available in said striking mechanism, via a transmission mechanism controlling an isolating wheel set, which is comprised in said selective stopping mechanism and arranged to control the position of said locking lever and further arranged to release or prevent the movement of a striking mechanism control rod linkage and/or to allow or prevent the strike of a hammer against a gong, wherein said selective stopping mechanism includes arranged to pivot with said output arbour, a cam, which cooperates with a feeler spindle comprised in said transmission mechanism for controlling, directly or indirectly, a movement of a rack, which controls a pivoting of an input stage of said isolating wheel set, wherein said isolating wheel set includes a striking mechanism stop cam and a striking mechanism stop wheel, superposed on each other and arranged to pivot about the same pivot axis, according to angular clearances that are limited in relation to each other, and acting against or by the action of elastic return means, and to control a movement of an output stage formed by a movement stop surprise-piece, and wherein a bearing surface and an operating area connected to each other are arranged to cooperate with said locking lever by respectively forming a stop member and a ramp for said locking lever.

2. The timepiece according to claim 1, wherein said selective stopping mechanism includes, mounted externally to said isolating wheel set, a toothed part including at least a first tooth and a second tooth, projecting substantially radially towards said pivot axis and the ends of which are located on a same first radius relative to said pivot axis and in at first angular distance relative thereto, and wherein said input stage includes, on the one hand, a toothed sector arranged to cooperate additionally with said rack to control a pivoting thereof, and on the other hand, a plate carrying a lifting piece with two beaks pivoting off-centre relative to said pivot axis, said lifting piece including a first beak projecting substantially radially relative to said pivot axis opposite thereto and an end of which is movable between two positions whose radius relative to said pivot axis is respectively smaller and greater than said first radius.

3. The timepiece according to claim 2, wherein said lifting piece with two beaks includes a second beak substantially radially relative to said pivot axis and turned towards said axis, and wherein said isolating wheel set further includes a cam which pivots relative to said pivot axis and which carries a pin substantially parallel to said pivot axis, said pin having limited mobility in a hole comprised in said plate angularly relative to said pivot axis, against said second beak which is pushed towards said pin by elastic return means.

4. The timepiece according to claim 3, wherein said cam includes a stud which, according to the angular position of said cam, prevents or allows the strike of at least one hammer on a gong, by being placed or not being placed between said hammer or gong.

5. The timepiece according to claim 3, wherein said cam includes a plurality of peripheral notches, which are each arranged to cooperate, in a particular angular position of said cam, with a beak comprised in an arm-click pushed towards said cam by elastic return means.

6. The timepiece according to claim 5, wherein said cam includes a stud which, according to an angular position of said cam, prevents or allows a strike of at least one hammer on a gong, by being placed or not being placed between said hammer or gong, and wherein, in one position of said beak in one said notch for locking one or more striking mechanisms, said stud is inserted between a first release hammer peculiar to said striking mechanisms and the corresponding gong, and wherein, in one position of said beak in one said notch for locking all the striking mechanisms which are manually released by a user, said stud is again inserted between a second release hammer peculiar to said striking mechanisms and the corresponding gong.

7. The timepiece according to claim 2, wherein said input stage carries a pin substantially parallel to the pivot axis thereof and which has limited mobility in a hole in said movement stop surprise-piece angularly relative to said pivot axis to limit the relative angular clearance between said movement stop surprise-piece and said striking mechanism stop wheel.

8. The timepiece according to claim 2, wherein said toothed sector includes an end which is used as support for elastic return means which tend to move said toothed sector away from said rack.

9. The timepiece according to claim 1, wherein said movement stop surprise-piece includes a peripheral rolling surface, connected to a notch, both arranged to cooperate with a roller pivotally mounted at one end of a spring subjected to a substantially radial movement relative to said pivot axis.

* * * * *